US005529877A

United States Patent [19]

Inaba et al.

[11] Patent Number: 5,529,877

[45] Date of Patent: Jun. 25, 1996

[54] MICROCAPSULE TONER AND PROCESSES FOR PREPARATION OF MICROCAPSULE AND MICROCAPSULE TONER

[75] Inventors: Yoshihiro Inaba; Ichiro Kawamoto, both of Minami-ashigara, Japan

[73] Assignee: Fuji Xerox Co., Ltd., Tokyo, Japan

[21] Appl. No.: 400,962

[22] Filed: Mar. 8, 1995

[30] Foreign Application Priority Data

Mar. 9, 1994 [JP] Japan ..... 6-064419

[51] Int. Cl.[6] ..... G03G 9/093

[52] U.S. Cl. ..... 430/138; 428/402.21

[58] Field of Search ..... 430/138; 428/402.21

[56] References Cited

U.S. PATENT DOCUMENTS

| | | | |
|---|---|---|---|
| 5,118,590 | 6/1992 | Kakimi | 430/138 |
| 5,332,584 | 7/1994 | Scher et al. | 424/408 |
| 5,376,495 | 12/1994 | Washizu et al. | 430/138 |

FOREIGN PATENT DOCUMENTS

| | | |
|---|---|---|
| 3819574 | 9/1938 | Japan . |
| 42446 | 1/1942 | Japan . |
| 52-108134 | 9/1977 | Japan . |
| 54-66844 | 5/1979 | Japan . |
| 55-18630 | 2/1980 | Japan . |
| 56-119137 | 9/1981 | Japan . |
| 57-41647 | 3/1982 | Japan . |
| 57-202547 | 12/1982 | Japan . |
| 58-9153 | 1/1983 | Japan . |
| 58-66948 | 4/1983 | Japan . |
| 58-145964 | 8/1983 | Japan . |
| 59-148066 | 8/1984 | Japan . |
| 59-159174 | 9/1984 | Japan . |
| 59-159177 | 9/1984 | Japan . |
| 59-162562 | 9/1984 | Japan . |
| 63-163373 | 7/1988 | Japan . |
| 64-40949 | 2/1989 | Japan . |
| 2-31381 | 7/1990 | Japan . |

OTHER PUBLICATIONS

*Modern Plastics Encyclopedia,* 1975–1976, "Plasticizers", E. J. Inchalik et al., pp. 222, 225, 228.

"Microcapsule" (Kondo et al.), *Sankyo Shuppan,* Nov. 1987, pp. 30–32.

*Primary Examiner*—John Goodrow

*Attorney, Agent, or Firm*—Oliff & Berridge

[57] ABSTRACT

The present invention provides a process for the preparation of a microcapsule excellent in core substance retention and mechanical strength as well as in environmental protection, safety and sanitation which can be used in the form of powder in a short capsulization time at a low cost. The present invention also provides an electrophotographic microcapsule toner having an excellent environmental stability of chargeability and a process for the preparation thereof. A novel process for the preparation of a microcapsule is provided which comprises emulsifying an oily composition containing a low boiling solvent in the presence of a cellulose dispersion stabilizer, and then subjecting the emulsion to interfacial polymerization so that it is capsulized, characterized in that said capsulization is effected at a temperature of not lower than the gelation temperature of said cellulose dispersion stabilizer while said low boiling solvent being removed from the oily droplets. In the case where a microcapsule toner is produced, as the oily composition there may be used one containing at least a coloring material, a fixing material and a shell-forming substance besides the low boiling solvent.

18 Claims, No Drawings

MICROCAPSULE TONER AND PROCESSES FOR PREPARATION OF MICROCAPSULE AND MICROCAPSULE TONER

FIELD OF THE INVENTION

The present invention relates to a process for the preparation of a microcapsule. More particularly, the present invention relates to a microcapsule toner for use in the development of an electrostatic latent image in electrophotography and electrostatic printing and a process for the preparation thereof.

BACKGROUND OF THE INVENTION

Various proposals have heretofore been made on microcapsules consisting of a core material and a shell covering the core material. Among these proposals, microcapsules whose capsule shell have been formed by interfacial polymerization are excellent in the completeness of covering of the core material and the inner retention and some of them have been put into practical use, e.g., non-carbon paper and pressure measuring paper. In these uses, the microcapsule is applied to a support such as paper with a proper binder resin. Thus, microcapsules particles are used in the form of suspension in the binder resin. However, if microcapsule particles are used in the form of independent powder, it is difficult to keep a volatile liquid in the core substance over a prolonged period of time because the capsule obtained by interfacial polymerization has a low mechanical strength and normally has a shell thickness of not more than 0.5 μm. In the production of interfacial polymerization type microcapsule, a method is normally employed which comprises using a low boiling solvent along with the core substance (see JP-A-56-119137 (The term "JP-A" as used herein means an "unexamined published Japanese patent application"), JP-A-58-145964, JP-A-63-163373, JP-A-64-40949, "New Microcapsulization Technology and Examples of Development of Its Application", Microcapsule Kenkyukai, pp. 50–52, Keiei Kaihatsu Center, September 1978, Tamotsu Kondo, Masumi Koishi, "Microcapsule", pp. 30–32, Sankyo Shuppan, November 1987). In some detail, an oily composition comprising a core substance, a capsule shell-forming monomer, a low boiling solvent, and optionally other additives is emulsified in an aqueous medium. The emulsion is then capsulized while the low boiling solvent being removed from the oily droplets. The low boiling solvent present in the oily droplets serves not only to lower the viscosity of the oily composition to facilitate emulsification but also to cause the capsule shell-forming monomer to migrate to the interface with the droplets to accelerate capsulization reaction. In accordance with this method, microcapsules can be normally obtained having a better mechanical strength and core substance retention than those obtained free of low boiling solvent.

However, this method is disadvantageous in that the low boiling solvent cannot be recovered. In this method, the reaction is allowed to proceed by evaporating the low boiling solvent from the reaction system to the atmosphere. If the low boiling solvent is recovered by distillation under reduced pressure, the reaction solution suffers from violent foaming, making it extremely difficult to recover the solvent. Further, the evaporation of the low boiling solvent to the atmosphere not only adds to production cost but also worsens the environmental protection, safety and sanitation. Moreover, in the case where capsulization is effected while the low boiling solvent being evaporated to the atmosphere, the reaction must be effected over a prolonged period of time to fully remove the low boiling solvent. If the low boiling solvent remains in the core, it causes a great problem when the microcapsule is used as a toner. In some detail, the solvent remaining in the core exudes out to the surface of the capsule and thus deteriorates the fluidity of the toner, resulting in the deterioration of chargeability and hence developability of the toner. The exudation of the solvent also causes the modification of the photoreceptor. Solvents having a relatively higher boiling point and a lower water solubility can remain in the core more remarkably.

In the case where the microcapsule is used as a toner, it is more difficult to assure both mechanical strength and core substance retention. Various proposals have heretofore been made on microcapsule toners comprising a capsule shell covering a core substance. For example, JP-A-54-66844, JP-A-55-18630, JP-A-57-41647, and JP-A-57-202547 disclose the use of a wax compound as a core substance. JP-A-52-108134, JP-A-58-9153, JP-A-59-159174, and JP-A-59-159177 disclose the use of a soft polymer as a core substance. Further, JP-A-56-119137, JP-A-58-145964, and JP-A-63-163373 disclose an interfacial polymerization type microcapsule toner comprising a polymer solution as a fixing component for core substance. Among these proposals, the interfacial polymerization type microcapsule toner comprising a polymer solution as a core component has an extremely excellent fixability but can hardly maintain a high boiling solvent in the polymer solution in the core substance. Further, the foregoing microcapsule toner can hardly maintain a sufficient mechanical strength without impairing the fixability thereof.

Since it has been believed that in a process for producing a microcapsule using cellulose dispersion stabilizer as a dispersant, the dispersion stabilizer undergoes gelation at an elevated temperature higher than gelation temperature to cause lowering of capsule strength. Therefore, the elevated temperature has not been used in the process. Further, in the prior arts, the stabilizer is not set in a form of gelation, but in a form of solution. Accordingly, when a low boiling solvent contained in a capsule is excluded from the system at a polymerizing step, foams are generated in the solution of the dispersant, i.e., paste-like solution, to be a foam-solution. Thereby, it has been difficult to recover the solvent contained in the foam-solution.

While, it has been found by the inventors that since the stabilizer is effective at only the initial stage of dispersion of the oily droplets into water, an interface polymerization takes place immediately at the interface of oily phase and hydrophilic phase to form polymer film (outer shell), after the dispersion once has been completed. Accordingly, it has been also found that the stabilizer is allowed to act in a minimized degree after formation of polymer film. As a result, it has been also found that the environmental temperature for polymerization higher than the temperature of gelation leads to providing rice grain-like gel of the dispersant in water, and thereby the low boiling solvent which is released from the water at the polymerization step is liable to be recovered under cooling.

SUMMARY OF THE INVENTION

It is therefore an object of the present invention to provide a process for the preparation of a microcapsule excellent in core substance retention and mechanical strength as well as in environmental protection, safety and sanitation which can be used in the form of powder in a short capsulization time at a low cost.

It is another object of the present invention to provide a process for the preparation of a microcapsule at a low cost by reducing the capsulization reaction time in the prior art.

It is a further object of the present invention to provide an electrophotographic microcapsule toner having an excellent environmental stability of chargeability.

It is a still further object of the present invention to provide a process for the preparation of an electrophotographic microcapsule toner which exhibits an excellent mechanical strength, requires neither special reaction apparatus nor complicated operation and can be used as a capsule toner having a liquid core without impairing the fixability that the core substance should possess.

These and other objects of the present invention will become more apparent from the following detailed description and examples.

As a result of extensive studies, the inventors found that the foaming involved in the distillation of the low boiling solvent in the reaction solution is mainly attributed to the dispersion stabilizer. It was also found that the foaming involved in the distillation of the low boiling solvent can be inhibited by using as a dispersion stabilizer a cellulose dispersion stabilizer whose thermal behavior can be made the best use of. A cellulose dispersion stabilizer has been known to undergo gelation at an elevated temperature. However, it has been found that when capsulization reaction is effected with a cellulose dispersion stabilizer as an emulsification stabilizer at a reaction solution temperature of not lower than the gelation temperature of the cellulose dispersion stabilizer, the low boiling solvent can be easily recovered. Thus, the present invention has been worked out.

The first aspect of the present invention concerns a process for the preparation of a microcapsule which comprises emulsifying an oily composition containing a low boiling solvent in the presence of a cellulose dispersion stabilizer, and then subjecting the emulsion to interfacial polymerization so that it is capsulized, characterized in that said capsulization is effected at a temperature of not lower than the gelation temperature of said cellulose dispersion stabilizer while said low boiling solvent being removed from the oily droplets.

The second aspect of the present invention concerns a microcapsule toner, prepared by a process which comprises emulsifying an oily composition containing at least a coloring material, a fixing material and a shell-forming substance with a low boiling solvent in the presence of a cellulose dispersion stabilizer to produce oily droplets, and then capsulizing said oily droplets at a temperature of not lower than the gelation temperature of said cellulose dispersion stabilizer while said low boiling solvent being removed from the oily droplets.

The third aspect of the present invention concerns a process for the preparation of a microcapsule toner which comprises the steps of emulsifying an oily composition containing at least a coloring material, a fixing material and a shell-forming substance with a low boiling solvent in the presence of a cellulose dispersion stabilizer to produce oily droplets, and then subjecting said oily droplets to interfacial polymerization so that said oily droplets are capsulized, characterized in that said interfacial polymerization in said capsulization step is effected at a temperature of not lower than the gelation temperature of said cellulose dispersion stabilizer while said low boiling solvent being removed from the oily droplets.

DETAILED DESCRIPTION OF THE INVENTION

The microcapsule and microcapsule toner to be used in the present invention are prepared by a so-called interfacial polymerization process. The interfacial polymerization process for the preparation of a microcapsule is disclosed in JP-B-38-19574 (The term "JP-B" as used herein means an "examined Japanese patent publication"), JP-B-42-446, JP-B-2-31381, JP-A-58-66948, JP-A-59-148066, and JP-A-59-162562.

In the process for the preparation of a microcapsule according to the present invention, an oily composition containing a low boiling solvent is first emulsified in the presence of a cellulose dispersion stabilizer to produce oily droplets.

The oily composition contains a low boiling solvent and a core substance. The oily composition further needs to contain a shell-forming substance for forming a capsule shell by interfacial polymerization. In general, as described in the above cited patents, a first capsule shell-forming monomer is incorporated in an oily composition which forms oily droplets while a second capsule shell-forming monomer is incorporated in an aqueous solvent. However, both the first capsule shell-forming monomer and second capsule shell-forming monomer may be incorporated in the oily composition.

Examples of the first capsule shell-forming monomer include isocyanate compound, acid halide compound, and epoxy compound.

Specific examples of the isocyanate compound include diisocyanates such as methaphenylene diisocyanate, tolylene diisocyanate, diphenylmethane diisocyanate, 3,3'-dimethyl-diphenyl-4,4'-diisocyanate, 3,3'-dimethyl-diphenylmethane-4,4'-diisocyanate, xylylene diisocyanate, naphthalene diisocyanate and hexamethylene diisocyanate, and polyisocyanates such as so-called buret type, adduct type and isocyanurate type. For example, polyisocyanates such as Sumidur Series available from Sumitomo Vier Urethane Co., Ltd., Takenate Series available from Takeda Chemical Industries, Ltd., and Millionate Series available from Nihon Polyurethane Co., Ltd. are preferred. Examples of the acid halide include dibasic halides such as adipoyl dichloride, phthaloyl dichloride, terephthaloyl dichloride and 1,4-cyclohexanedicarbonyl chloride. Examples of the epoxy compound include epoxy compounds known as bisphenol A type, resorcinol type, bisphenol F type, tetraphenylmethane type, novolak type, polyalcohol type, polyglycol type and glycerintriether type.

Preferred among these capsule shell-forming monomers for use in the preparation of a microcapsule toner are isocyanate compounds from the standpoint of electrical resistance. Particularly preferred among these isocyanate compounds are polyisocyanates. In an even preferred embodiment, polyisocyanates which are soluble in a low boiling solvent but are not fully soluble in a mixture of a core substance and a low boiling solvent to provide suspensions are employed. This is because that this embodiment allows the smooth migration of the first shell-forming monomer to the interface with droplet, resulting in the efficient progress of capsulization or shell formation.

The term "second capsule shell-forming monomer" as used herein is meant to indicate a monomer which reacts with the foregoing first capsule shell-forming monomer to produce a polymer. Specific examples of the second capsule shell-forming monomer include water; polyols such as ethylene glycol, 1,4-butanediol, catechol, resorcinol, hydroquinone, o-dihydroxymethylbenzene, 4,4'-dihydroxydiphenylmethane and 2,2-bis(4-hydroxyphenyl)-propane; polyamines such as ethylenediamine, tetramethylenediamine, hexamethylenediamine, phenylenediamine, diethylenetriamine, triethylenetetramine, diethylaminopropylamine and tetraethylenepentamine, and piperazine compounds such as piperazine, 2-methylpiperazine and 2,5-dimethylpiperazine. These compounds may be used in admixture. In a particularly preferred embodiment, the oily composition comprises an isocyanate compound as the first capsule shell-forming monomer while water and a polyamine are used as second capsule shell-forming monomers.

Such a second capsule shell-forming monomer is incorporated in an aqueous medium having an oily composition emulsified therein. For example, a part of the polyamine to be added may be previously incorporated in the aqueous medium prior to emulsion. If a polyol is used, it may be incorporated in the oily droplets with the first capsule shell-forming monomer.

The low boiling solvent to be incorporated in the oily composition in the present invention will be further described hereinafter. The low boiling solvent to be used in the present invention is a solvent having a boiling point of not higher than 120° C., preferably not higher than 100° C., at 760 mmHg. It is incorporated in the oily composition as a component of the capsule with the core substance and first shell-forming substance and removed from the system during the emulsification and capsulization reaction. The low boiling solvent not only serves as a diluent for lowering the viscosity of the core substance to facilitate emulsification but also serves to allow the efficient migration of the first shell-forming substance to the interface of droplets to accelerate the reaction with the second shell-forming substance.

Examples of the low boiling solvent employable in the present invention include ester solvents such as ethyl acetate and butyl acetate; ketone solvents such as methylethyl ketone, methyl isopropyl ketone and methyl isobutyl ketone; aromatic solvents such as toluene and xylene; and halogenated hydrocarbon solvents such as dichloromethane and chloroform. Particularly preferred among these solvents are ethyl acetate and methyl isopropyl ketone, which form an azeotrope with water and thus can be easily distilled.

The core substance to be incorporated in the oily composition is not specifically limited so far as it is oil-soluble. If the microcapsule serves as a microcapsule toner (hereinafter referred to as "capsule toner"), it is necessary that at least a coloring material and a fixing material be incorporated therein as core substances.

Examples of the coloring material include inorganic pigments such as carbon black, red oxide, Prussian blue and titanium oxide; azo pigments such as fast yellow, disazo yellow, pyrazolone red, chelate red, brilliant carmine and parabrown; phthalocyanine pigments such as copper phthalocyanine blue and metal-free phthalocyanine; and condensed polycyclic pigments such as flavanthrone yellow, dibromoanthrone orange, perylene red, quinacridone red and dioxazine violet. Further, disperse dyes and oil-soluble dyes may be used. If necessary, a magnetic powder may be used instead of such a coloring material. For example, if the capsule toner is used as a magnetic unitary toner, a black coloring material may be partially or entirely replaced by a magnetic powder. As such a magnetic powder there may be used a particulate magnetite or ferrite or a metal such as cobalt, iron and nickel or alloy thereof in particulate form.

The coloring material or magnetic powder incorporated as a component of the core substance may be present on the core-shell interface or in the shell after the formation of capsules.

Referring to the fixing material, if it is adapted for pressure fixing, a fixing material mainly composed of a pressure-fixable component is used. If it is adapted for heat fixing, a fixing material mainly composed of a heat-fixable component is used. In particular, if it is adapted for pressure fixing, a fixing material mainly composed of a binder resin and a high boiling solvent for dissolving it therein or mainly composed of a soft solid substance is preferred. For the purpose of improving the fixability of the fixing material, an additive such as silicone oil may be added thereto. Further, a high boiling solvent which doesn't dissolve the binder resin therein may be added to the high boiling solvent for dissolving the binder therein. The kind or composition ratio of constituents preferably varies depending on fixing system of pressure fixing or heat fixing.

As the binder resin there may be used a known fixing resin. Specific examples of such a known fixing resin employable in the present invention include acrylate polymers such as polymethylacrylate, polyethylacrylate, polybutylacrylate, poly-2-ethylhexylacrylate and polylaurylacrylate; methylacrylate polymers such as polymethylmethacrylate, polybutylmethacrylate, polyhexylmethacrylate, poly-2-ethylhexylmethacrylate and polylaurylmethacrylate; ethylenic polymers and copolymers thereof such as copolymer of styrene monomer with acrylate or methacrylate, polyvinylacetate, polyvinylpropionate, polyvinylbutyrate, polyethylene and polypropylene; styrene copolymers such as styrene-butadine copolymer, styrene-isoprene copolymer and styrene-maleic acid copolymer, polyvinylethers, polyvinylketones, polyesters, polyamides, polyurethanes, rubbers, epoxy resins, polyvinylbutyral, rosins, modified rosins, terpene resins, and phenolic resins. These binder resins may be used singly or in admixture. Alternatively, these binder resins may be incorporated in the form of monomer so that they can be polymerized into a binder resin after capsulization.

As the high boiling solvent for dissolving the binder resin therein there may be used an oily solvent having a boiling point of not lower than 140° C., preferably not lower than 160° C. Such an oily solvent can be selected from those described in, e.g., clause "Plasticizers" in "Modern Plastics Encyclopedia", 1975–1976. Further, the oily solvent can be selected from high boiling solvents disclosed as core substances for pressure-fixable capsule toner in, e.g., JP-A-58-145964 and JP-A-63-163373.

Specific examples of the high boiling solvent include phthalic esters (e.g., diethyl phthalate, dibutyl phthalate), aliphatic dicarboxylic esters (e.g., diethyl malonate, dimethyl oxalate), phosphoric esters (e.g., tricresyl phosphate, trixylyl phosphate), citric esters (e.g., o-acetyltriethyl citrate), aromatic esters (e.g., butyl benzoate, hexyl benzoate), aliphatic esters (e.g., hexadecyl myristate, dioctyl adipate), alkylnaphthalenes (e.g., methyl naphthalene, dimethylnaphthalene, monoisopropyl naphthalene, diisopropyl naphthalene), alkyldiphenyl ethers (e.g., o-, m-, p-methylphenyl ether), higher aliphatic or aromatic sulfonic amide compounds (e.g., N,N-dimethyllauroylamide, N-butylbenzenesulfonamide), trimellitic esters (e.g., trioctyl trimellitate), diarylalkanes (e.g., diarylmethane such as dimethyldiphenylmethane, diarylethane such as 1-phenyl-1methylphenylethane, 1-dimethylphenyl-1-phenylethane and 1-ethylphenyl-1-phenylethane), and chlorinated paraffins. If a polymer having a long-chain alkyl group such as lauryl methacrylate homopolymer or copolymer is used as a binder resin, an organic solvent mainly composed of aliphatic saturated hydrocarbon or aliphatic saturated hydrocarbon (e.g., Isopar-G, Isopar-H, Isopar-M, available from Exxon Inc.) may be used.

As the soft solid substance there may be any kind of a material which is normally flexible and fixable at a room temperature. A polymer having Tg of −60° C. to 5° C. or a mixture thereof with other polymers is preferred.

As the method for incorporating the soft solid substance in capsules as a component of the core substance there may be used a method which comprises charging the soft solid substance in the form of polymer with other core substance components, the low boiling solvent and the shell-forming components, and then expelling the low boiling solvent from the system at the same time with or after the formation of the shell by the interfacial polymerization process to produce a core substance. Alternatively, a method may be used which comprises charging the soft solid substance in the form of monomer, subjecting the system to interfacial polymerization to form a shell, and then polymerizing the monomer to produce a core substance.

The composition ratio of the various components in the oily composition of the present invention can be determined to a proper range as necessary. In the case of capsule toner, the percentage of low boiling solvent, coloring material, fixing agent and core-shell substance are preferably in the range of 10 to 60% by weight, 1 to 60% by weight, 20 to 80% by weight, and 5 to 30% by weight, respectively, based on the total weight of the raw materials.

If the foregoing oily composition is emulsified in an aqueous medium, a cellulose dispersion stabilizer may be used for the purpose of stabilizing the emulsification of the oily composition. The term "cellulose dispersion stabilizer" as used herein means a cellulose which has been rendered water-soluble by chemical treatment and becomes turbid to gel when heated in the form of aqueous solution. In particular, a water-soluble cellulose ether obtained by treating a cellulose with caustic soda, and then reacting the treated cellulose with an etherifying agent such as methyl chloride, propylene oxide and ethylene oxide is preferred. This is because that such a water-soluble cellulose ether can provide a high viscosity even at a low concentration to give an excellent dispersion stability. Specific examples of such a water-soluble cellulose ether include hydroxymethyl cellulose, hydroxyethyl cellulose, hydroxyethylmethyl cellulose, hydroxypropyl cellulose, and hydroxypropylmethyl cellulose. These water-soluble cellulose ethers are commercially available. Examples of such commercially available water-soluble cellulose ethers include Metrose Series produced by Shin-Etsu Chemical Co., Ltd. Preferred among these products are Metrose 65SH50, 65SH4000, 90SH400, 90SH4000, SEB04T, etc. Water-soluble cellulose ethers having a higher gelation temperature can foam more difficultly and thus can be used more preferably. More preferably, the gelation temperature of the water-soluble cellulose ethers is not lower than 60° C. These cellulose dispersion stabilizers may be used in an amount of from 0.1 to 10 g based on 100 g of aqueous medium used.

"Gelation temperature" generally has two meanings, i.e., a temperature ($T_1$) at which viscosity decrease is started and a temperature ($T_2$) at which viscosity increase is started. In the present invention, the gelation temperature means the former, i.e., a temperature ($T_1$) at which viscosity decrease is started.

For example, Metrose 65SH50 and Metrose 65SH4000 each have 60° C. of gelation temperature ($T_1$), Metrose 90SH400 and Metrose 90SH4000 each have 70° C. of gelation temperature ($T_1$) and SEB04T has 70° C. of gelation temperature ($T_1$).

The temperature ($T_2$) at which viscosity increase is started is generally higher than the temperature ($T_1$) at which viscosity decrease is started. For instance, Metrose 65SH50 and Metrose 65SH4000 each have 75° C. of gelation temperature ($T_2$), Metrose 90SH400 and Matrose 90SH4000 each have 80° C. of gelation temperature ($T_2$) and SEB04T has 85° C. of gelation temperature ($T_2$).

The size of the oily droplets thus formed may be properly determined. In the case of capsule toner, it is preferably in the range of 3 to 20 μm.

The emulsion thus formed is then heated so that the oily droplets undergo interfacial polymerization and capsulization. During this process, heating needs to be effected to a temperature of not lower than the gelation temperature of cellulose dispersion stabilizer. More particularly, the heating temperature is preferably about 10° to 50° C. higher than the gelation temperature of the cellulose dispersion stabilizer.

During this process, capsulization needs to be effected while the low boiling solvent is removed from the oily droplets by distillation. After the completion of capsulization, the low boiling solvent present in the aqueous medium and in capsules may be distilled off. However, it takes much time to complete the distillation of the low boiling solvent. Further, this process can disadvantageously give different capsule shapes.

The distillation of the low boiling solvent may be effected under either reduced or normal pressure. During this process, the low boiling solvent is preferably drawn out from the reaction system by taking advantage of azeotropy with water, and then recovered through a condenser. In particular, the distillation of the low boiling solvent is preferably effected under normal pressure because it foams less to provide an easier operation. Further, the distillation of the low boiling solvent may be effected in the presence of an anti-foaming agent.

When capsulization is effected in the foregoing manner, the first shell-forming substance and the second shell-forming substance undergo polymerization reaction on the interface of the oily droplets and the aqueous medium to form a capsule shell. The microcapsules thus obtained may be separated from the system by an ordinary method, and then dried.

In the case of capsule toner, a chargeability-controlling polymer is preferably attached to the surface of the shell of the microcapsules thus formed to provide the capsule particles with chargeability. Examples of the method for attaching the chargeability-controlling polymer to the surface of the capsule shell include (1) a method which comprises applying a chargeability-controlling polymer to a toner by spray drying, heating or pressure, (2) a method which comprises chemically bonding a bridging molecule such as ethylene glycol dimethacrylate to the surface of a toner by graft polymerization, and then causing a polymerizable monomer having a chargeability-controlling group to be polymerized, and (3) a method which comprises allowing capsule particles to be suspended in water, and then allowing a monomer to be polymerized in the suspension so that the polymer is attached to the surface of capsules. Preferred among these methods are the methods (2) and (3), which enable submerged treatment and thus require no special apparatus.

Examples of the polymerizable monomer include (meth-)acrylic acid; (meth)acrylic esters such as methyl (meth-)acrylate, ethyl (meth)acrylate, propyl (meth)acrylate, butyl (meth)acrylate, pentyl (meth)acrylate, hexyl (meth)acrylate, lauryl (meth)acrylate, cyclohexyl (meth)acrylate, 2-ethylhexyl (meth)acrylate, benzyl (meth)acrylate, hydroxyethyl (meth)acrylate, hydroxypropyl (meth)acrylate, 2-ethoxyethyl (meth)acrylate, glycidyl (meth)acrylate, phenyl (meth-)acrylate, trifluoroethyl (meth)acrylate, acrylonitrile, dimethylaminoethyl (meth)acrylate and diethylaminoethyl (meth)acrylate; aliphatic vinyl esters such as vinyl formate, vinyl acetate, vinyl propionate, vinyl butyrate, vinyl trimethylacetate, vinyl caproate, vinyl caprylate and vinyl stearate; vinyl ethers such as ethyl vinyl ether, propyl vinyl ether, butyl vinyl ether, hexyl vinyl ether, 2-ethylhexyl vinyl ether and phenyl vinyl ether; vinyl ketones such as methyl vinyl ketone and phenyl vinyl ketone, vinyl aromatic compounds such as styrene, chlorostyrene, hydroxystyrene and α-methylstyrene, (meth)acrylic ester ammonium salt monomers such as acryloyloxyethyl trimethylammonium chloride, acryloyloxyethyl triethylammonium chloride, methacryloyloxyethyl trimethylammonium chloride, methacryloyloxyethyl triethylammonium chloride and methacryloyloxyethyl tribenzylammonium chloride; (meth)acrylamide ammonium salt monomers such as acrylamido-trimethylpropyl ammonium chloride, acrylamido-triethylpropyl ammonium chloride, methacrylamido trimethylpropylammonium chloride and methacrylamido-benzylpropylammonium chloride; vinylbenzyl ammonium salt monomers such as vinylbenzyl triethylammonium chloride and vinylbenzyl trimethylammonium chloride; vinylpyridium salt monomers such as N-butylvinylpyridium bromide and N-cetylvinylpyridium chloride; vinyl monomers having quaternary nitrogen such as vinylimidazolium salt monomer (e.g., N-vinyl-2-methylimidazolium chloride and N-vinyl-2,3-dimethylimidazolium chloride), and vinyl monomers obtained by replacing halogen ions in these vinyl monomers by different organic anions. These monomers may be used singly or in admixture. Particularly preferred among these monomers are (meth)acrylic esters, (meth)acrylic ester ammonium salt monomers, and (meth)acrylamidoammonium salt monomers.

The present invention will be further described in the following examples, but the present invention should not be construed as being limited thereto.

EXAMPLE 1

(Preparation of capsule particles)

To a mixture of 60 g of an aliphatic saturated hydrocarbon (Isoper-M, available from Exxon Corp.) and 60 g of methyl isopropyl ketone was added 70 g of a styrene-lauryl methacrylate (50 wt. %:50 wt. %) ($Mw=8\times10^4$) to make a solution. To the resulting solution was then added 120 g of a magnetic powder (EPT-1000, available from Toda Kogyo Corp.). The mixture was then subjected to dispersion by means of a sand mill for 3 hours. To 200 g of the resulting dispersion were then added 40 g of an isocyanate compound (Takenate D110N, available from Takeda Chemical Industries, Ltd.) and 20 g of methyl isopropyl ketone. The mixture was then thoroughly mixed to obtain Solution A.

Separately, 10 g of hydroxypropyl methyl cellulose (Metrose 90SH4000; gelation temperature: 70° C.; available from Shin-Etsu Chemical Co., Ltd.) were dissolved in 200 g of ion-exchanged water. The solution was then cooled to a temperature of 5° C. to obtain Solution B.

Solution B was then stirred by means of an emulsifier (autohomomixer, available from Shuki Kakosha K.K.). Into the solution was then slowly charged Solution A to effect emulsification. In this manner, an O/W type emulsion comprising oily droplets having an average particle diameter of about 12 μm was obtained.

The O/W type emulsion thus obtained was stirred in a separable flask equipped with a propeller agitating blade and a Liebig condenser at 400 r.p.m. During this process, 200 g of a 5% aqueous solution of diethylene triamine was added dropwise to the emulsion. After the completion of dropwise addition, the emulsion was heated to a temperature of 90° C. After 15 minutes, methyl isopropyl ketone was distilled off in azeotropy with water. After 1 hour, the reaction was completed. The percent recovery of methyl isopropyl ketone was 90%. The resulting capsule slurry was then poured into 2 l of ion-exchanged water. The mixture was thoroughly stirred, and then allowed to stand. After the sedimentation of capsule particles, the supernatant liquid was removed. This procedure was repeated seven times to wash the capsule particles. The resulting capsule suspension was emptied into a stainless steel tray, and then dried at a temperature of 80° C. in a dryer (available from Yamato Kagaku K.K.) for 24 hours. In this manner, the desired microcapsule was obtained.

The microcapsule thus obtained was partially withdrawn and heated to a temperature of 100° C. for 24 hours to determine the evaporation loss of Isoper-M from the capsules. As a result, it was confirmed that about 98% of Isoper-M originally present in the capsules had remained therein. These capsule particles were compressed to determine the percent breakage thereof. As a result, the percent breakage of the capsule particles was 8% at 4.9 MPa (50 $kgf/cm^2$). From these results, the microcapsule thus obtained was confirmed to have an excellent core substance retention and mechanical strength.

EXAMPLE 2

(Preparation of toner)

Capsule particles which had been prepared in the same manner as in Example 1 were subjected to centrifugal separation to obtain a cake having a solid concentration of 75%. 67 g of the cake (corresponding to 50 g of capsule particles) was then charged into a 500-ml separable flask. To the cake was then added 200 g of ion-exchanged water having 3 g of methyl methacrylate dissolved therein. The cake was then stirred at 200 r.p.m. by means of an agitator equipped with a propeller agitating blade (Three One Motor, available from Shinto Kagaku K.K.). The atmosphere of the separable flask was then replaced by nitrogen. To the cake were then added 0.3 g of methacryloyloxyethyl trimethylammonium chloride and 0.2 g of a polymerization initiator (VA-044, available from Wako Junyaku K.K.). The reaction system was then allowed to undergo reaction at a temperature of 45° C. for 5 hours. After the completion of reaction, the reaction solution was poured into 2 l of ion-exchanged water. The solution was then filtered under reduced pressure. The capsule particles were then washed with 1 l of ion-exchanged water.

To these capsule particles was then added 100 g of a 0.01% aqueous solution of caustic soda. The mixture was then stirred at room temperature for 30 minutes. The solution was then poured into 1 l of ion-exchanged water. The solution was then filtered under reduced pressure. The capsule particles were again washed with 1 l of ion-exchanged water. To the capsule particles was then added 2 g of a 5% aqueous solution of sodium 4-naphtholsulfonate. The mixture was then stirred at room temperature to effect ion exchange reaction. After the completion of reaction, the mixture was filtered under reduced pressure, and then washed with 1 l of ion-exchanged water. In this manner, a capsule toner comprising chargeability-controlling polymer attached to the surface of capsule particles was obtained. The resulting toner cake was emptied into a stainless steel tray, and then dried at a temperature of 60° C. in a dryer (available from Yamato Kagaku K.K.) for 10 hours. To 100 parts of the capsule toner thus obtained were then added 0.1 parts of a basic carbon black (pH value: 8.5) (REGAL330R: available from Cabot Corp.). The mixture was then thoroughly mixed.

The capsule toner thus obtained had no smell of methyl isopropyl ketone. The capsule toner was smashed, and then measured for the content of methyl isopropyl ketone by gas chromatography. As a result, no methyl isopropyl ketone was detected.

The capsule toner was then evaluated for image quality under an atmosphere of 20° C. and 50% RH. The copying machine used for the evaluation of image quality was a Fuji Xerox's Type 2700 which had been remodelled for capsule toner. As a result, a stable duplication could be made free of image defects up to 5,000th sheet. The toner feed roll and the photoreceptor were observed. As a result, no attachment of smashed toner was found.

COMPARATIVE EXAMPLE 1

A comparative microcapsule was prepared in the same manner as in Example 1 except that the reaction was effected with the flask being made airtight to cause no distillation of methyl isopropyl ketone.

The microcapsule thus obtained was partially withdrawn, and then heated to a temperature of 100° C. for 24 hours to determine the evaporation loss of Isoper-M therefrom. As a result, it was found that about 50% of Isoper-M originally present in the capsule had disappeared. The capsule particles were then compressed to determine the percent break thereof. As a result, it was found to be 50% at 4.9 MPa (50 kgf/cm$^2$). From these results, this microcapsule was found to have a poor core substance retention and mechanical strength.

COMPARATIVE EXAMPLE 2

The distillation of methyl isopropyl ketone under reduced pressure was attempted in the same manner as in Example 1 except that the capsulization reaction was effected at a temperature of 60° C., which is lower than the gelation temperature. However, violent foaming occurred, making it impossible to recover methyl isopropyl ketone.

COMPARATIVE EXAMPLE 3

The microcapsule prepared in Comparative Example 1 was processed to produce a toner in the same manner as in Example 2. The capsule toner thus obtained smelled of methyl isopropyl ketone. The capsule toner was smashed, and then measured for the content of methyl isopropyl ketone by gas chromatography. As a result, it was found that methyl isopropyl ketone had remained in a proportion of 5% based on the total weight of the capsule.

The capsule toner thus obtained was then evaluated for image quality under an atmosphere of 20° C. and 50% RH in the same manner as in Example 2. As a result, smashed toner was attached to the surface of the toner feed roll even when the 1st sheet of copying paper was supplied into the copying machine. Numerous white lines were formed on the 100th sheet and after. Thus, a remarkably poor image quality was shown. The surface of the photoreceptor was observed. As a result, it was confirmed that smashed toner had been attached to the surface of the photoreceptor.

As mentioned above, in accordance with the process for the preparation of a microcapsule of the present invention, capsulization is effected at a temperature of not lower than the gelation temperature of the cellulose dispersion stabilizer while the low boiling solvent being removed from the oily droplets, making it possible to produce a microcapsule excellent in core substance retention and mechanical strength as well as in environmental protection, safety and sanitation which can be used in the form of powder in a short capsulization time at a low cost. The microcapsule toner produced according to the present invention has an excellent environmental stability of chargeability and thus can be used as an electrophotographic developer.

While the invention has been described in detail and with reference to specific embodiments thereof, it will be apparent to one skilled in the art that various changes and modifications can be made therein without departing from the spirit and scope thereof.

What is claimed is:

1. A process for the preparation of a microcapsule, said process comprising: emulsifying an oily composition containing a low boiling solvent in the presence of a cellulose dispersion stabilizer, to form an emulsion containing oily droplets and then subjecting said emulsion to interfacial polymerization so that said oily droplets are capsulized, wherein capsulization is effected at a temperature of not lower than a gelation temperature of said cellulose dispersion stabilizer while said low boiling point solvent is removed from said oily droplets.

2. The process for the preparation of a microcapsule according to claim 1, wherein removal of said low boiling solvent from said oily droplets is effected by drawing said low boiling solvent out from the emulsion by taking advantage of azeotropy with water and then recovering said low boiling solvent through a condenser.

3. The process for the preparation of a microcapsule according to claim 1, wherein said cellulose dispersion stabilizer is a water-soluble cellulose ether.

4. A microcapsule toner, prepared by a process which comprises emulsifying an oily composition containing at least a coloring material, a fixing material and a shell-forming substance together with a low boiling solvent in the presence of a cellulose dispersion stabilizer to produce oily droplets, and then capsulizing said oily droplets at a temperature of not lower than a gelation temperature of said cellulose dispersion stabilizer while said low boiling solvent is removed from said oily droplets.

5. A process for the preparation of a microcapsule toner which comprises the steps of emulsifying an oily composition containing at least a coloring material, a fixing material and a shell-forming substance together with a low boiling solvent in the presence of a cellulose dispersion stabilizer to produce oily droplets, and then subjecting said oily droplets to interfacial polymerization so that said oily droplets are capsulized, wherein said interfacial polymerization in said subjecting step is effected at a temperature of not lower than a gelation temperature of said cellulose dispersion stabilizer while said low boiling solvent is removed from said oily droplets.

6. A process according to claim 1, wherein said temperature effecting capsulization is from to 10° C. to 50° C. higher than said gelation temperature.

7. A process according to claim 1, wherein said low boiling solvent has a boiling point less than 120° C. at 760 mm Hg.

8. A process according to claim 7, wherein said boiling point is less than 100° C. at 760 mm Hg.

9. A process according to claim 1, wherein said gelation temperature is at least 60° C.

10. A process according to claim 1, wherein said cellulose dispersion stabilizer is present at a concentration from 0.1 g to 10 g/100 g aqueous medium.

11. A process according to claim 5, wherein said oily droplets are from 3 to 20 μm in diameter.

12. A process according to claim 5, wherein said coloring material is present at 1 to 60% by weight of total raw materials.

13. A process according to claim 5, wherein said fixing material is present at from 20 to 80% by weight of total raw materials.

14. A process according to claim 5, wherein said shell-forming substance is present at 5 to 30% by weight of total raw materials.

15. A process according to claim 5, wherein said low boiling solvent is present at from 10 to 60% by weight of total raw materials.

16. A process according to claim 5, wherein said fixing material comprises a high boiling solvent having a boiling point greater than 140° C.

17. A process according to claim 16, wherein said boiling point is greater than 160° C.

18. A process according to claim 5, wherein said fixing material comprises a soft solid substance, said substance being normally flexible and fixable at a room temperature and said substance being a polymer having a glass transition temperature (Tg) of −60° C. to 5° C.

* * * * *